US005343845A

United States Patent [19]

Fehlmann

[11] Patent Number: 5,343,845

[45] Date of Patent: Sep. 6, 1994

[54] FUEL INJECTION PUMP FOR INTERNAL-COMBUSTION ENGINES

[75] Inventor: Wolfang Fehlmann, Stuttgart, Fed. Rep. of Germany

[73] Assignee: Robert Bosch GmbH, Stuttgart, Fed. Rep. of Germany

[21] Appl. No.: 946,485

[22] PCT Filed: Apr. 25, 1991

[86] PCT No.: PCT/DE91/00341

§ 371 Date: Nov. 3, 1992

§ 102(e) Date: Nov. 3, 1992

[87] PCT Pub. No.: WO91/18200

PCT Pub. Date: Nov. 28, 1991

[30] Foreign Application Priority Data

May 21, 1990 [DE] Fed. Rep. of Germany ..... 4016309

[51] Int. Cl.[5] ..... F02M 37/04

[52] U.S. Cl. ..... 123/506; 123/449

[58] Field of Search ..... 123/506, 458, 500, 501, 123/449, 502; 251/129.06

[56] References Cited

U.S. PATENT DOCUMENTS

| | | | |
|---|---|---|---|
| 4,597,369 | 7/1986 | Yasuhara | 123/458 |
| 4,633,837 | 1/1987 | Babitzka | 123/446 |
| 4,643,155 | 2/1987 | O'Neill . | |
| 4,831,986 | 5/1989 | Linder | 123/458 |
| 4,884,549 | 12/1989 | Kelly | 123/506 |
| 4,974,564 | 12/1990 | Laufer | 123/506 |
| 5,186,151 | 2/1993 | Schwerdt | 123/506 |

FOREIGN PATENT DOCUMENTS

| | | | |
|---|---|---|---|
| 0078983 | 5/1983 | European Pat. Off. . | |
| 3429129 | 2/1986 | Fed. Rep. of Germany . | |
| 0041462 | 3/1982 | Japan | 123/506 |
| 0128967 | 7/1984 | Japan | 123/458 |
| 2061403 | 5/1981 | United Kingdom . | |

*Primary Examiner*—Carl S. Miller
*Attorney, Agent, or Firm*—Michael J. Striker

[57] ABSTRACT

A fuel injection pump for internal combustion engines has a pump cylinder, a pump plunger enclosing a pump work space and reciprocating in the pump cylinder, a fuel injection valve, a fuel injection line connectable with the pump work space and leading to the fuel injection valve, a fuel supply, a fuel duct connecting the pump work space with the fuel supply, an electrically actuated valve controlling the fuel duct, a filling duct connecting the pump work space with the fuel supply, so that the fuel flows through the fuel duct when the electrically controlled valve is open in a filling position as well as in an emptying position depending on a pump plunger movement.

8 Claims, 2 Drawing Sheets 34
33
13
15
16
15
10
2
12
7
8
22
9
1
6
-17-
4
29
30
25
31
24
23
28
27
18
20
19

FUEL INJECTION PUMP FOR INTERNAL-COMBUSTION ENGINES

BACKGROUND OF THE INVENTION

The present invention relates to a fuel injection pump for internal combustion engines.

More particularly, it relates to a fuel injection pump which has a pump plunger enclosing a pump work space in a pump cylinder and a cam drive controlling the reciprocating movement of the pump plunger.

In such a known fuel injection pump a non-return valve opening into the suction space of a distributor fuel injection pump is arranged in the fuel duct downstream of the magnet valve in the flow direction toward the fuel tank. In addition, the rear of the non-return valve in the filling duct is connected with the fuel duct. The object of this arrangement is to prevent the non-return valve serving to fill the pump work space from opening in the event that the electrically actuated valve remains stuck in its closed position. This would cause an excess quantity of fuel to be delivered with each delivery stroke of the pump plunger since there exists between the electrically actuated valve and the non-return valve of the fuel duct a counter-pressure which is determined by the opening pressure of the non-return valve in the fuel duct and is greater than the opening pressure acting on the non-return valve in the filling duct. Accordingly, the internal combustion engine is protected from damage as a result of defective operation of the electrically actuated valve.

In other fuel injection pumps it is known to fill and also to empty the pump work space via the electrically actuated valve. In so doing, the electrically actuated valve must be outfitted with a sufficiently large opening cross section so that the injection phase can be terminated quickly and the pump work space can be filled from the fuel tank during its filling stroke at a constant pressure. This large cross section increases the cost of the electrically actuated valve which is preferably constructed as a magnet valve. Moreover, at a given electromagnetic force the actuating time increases with the opening cross section, which works to the disadvantage of an exact and quick control in all speed ranges of the internal combustion engine.

SUMMARY OF THE INVENTION

Accordingly, it is an object of the present invention to provide a fuel injection pump of the above mentioned general type, which avoids the disadvantages of the prior art.

In keeping with these objects and with others which will become apparent hereinafter, one feature of the present invention resides, briefly stated, in a fuel injection pump in which fuel can flow through a fuel duct which connects the pump work space with a fuel supply and is controlled by an electrically actuated valve, where the electrically control valve is open in the filling position as well as in the emptying position depending on the pump plunger movement.

When the fuel injection pump is designed in accordance with the present invention, it has the advantage over the prior art that the electrically controlled valve need only meet the requirements for relieving the pump work space. For this purpose it is sufficient to lower the pressure in the pump work space to a certain extent to end the injection without the need for the pump work space to take on the pressure of the fuel supply. On the other hand, in addition to the open cross section of the electrically actuated valve, the cross section of the non-return valve in the filling duct is also available for the filling of the pump work space during the suction stroke of the pump plunger. It is accordingly ensured that the pump work space itself is always sufficiently filled to a desired extent even with a small cross section of the electrically actuated valve and accordingly with a small overall height. In so doing, the switching times of the electrically actuated valve can be shorter at a given overall height and expenditure. Expenditure on construction and the energy requirement for the fuel injection pump are improved overall.

The novel features which are considered as characteristic for the invention are et forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
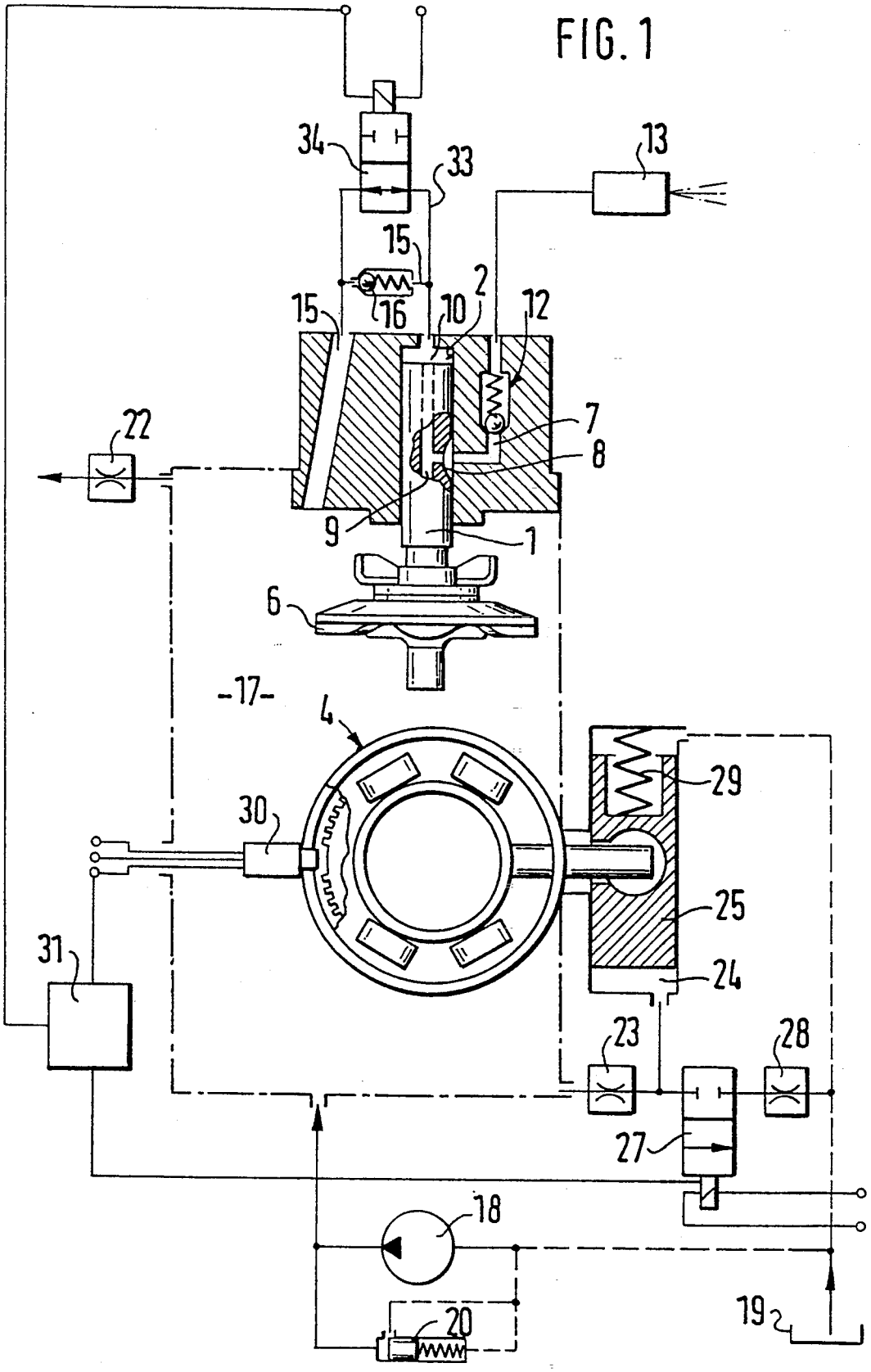
FIG. 1 is a schematic view of the construction of a reciprocating piston type distributor fuel injection pump.

In a reciprocating piston-type distributor fuel injection pump in accordance with the present invention a A pump plunger 1 is driven so as to move in a reciprocating and rotating manner simultaneously in a pump cylinder 2 by a cam disk 6 running on a roller ring 4 (shown here swiveled by 90° and offset). During the rotating movement the pump plunger simultaneously serves as a distributor alternately controlling one of a plurality of injection lines 7 arranged so as to be distributed around the pump cylinder 2 during the course of its rotation via a distributor slot 8. The distributor slot is permanently connected, via a longitudinal duct 9 in the pump plunger, with a pump work space 10 enclosed by the pump plunger in the pump cylinder 2. The injection lines lead via a pressure valve 12 to an injection valve 13. The pump plunger is held at the cam disk via a spring, not shown, and the cam disk at the rollers of the roller ring. During the suction stroke of the pump the fuel is connected with a pump suction space 17 serving as fuel supply via a filling duct 15 in which is arranged a non-return valve opening in the direction of the pump work space. The pump suction space is supplied with fuel from a fuel tank 19 by a fuel delivery pump 18 and kept at a determined pressure via a pressure control valve 20. The pump suction space is connected with the filling duct 15 and, via a flushing choke 22, with the fuel tank and with the suction side of the fuel delivery pump 18 and is connected via a decoupling choke 23 with a work space 24 prior to an injection-start timing piston 25. The work space 24 is clocked or can be relieved toward the supply tank 19 in an analogous manner via an electromagnet valve 27 and a subsequently connected choke 28. Therefore the pressure in the work space can be modified independently from the pressure in the suction space 17 when the electromagnets are controlled in a corresponding manner. The injection-start timing piston is displaceable by the pressure in the work space 24, which is adjusted in a corresponding manner in the latter, against the force of a return spring 29 and in so doing adjusts the rotational position of the roller ring 4. This rotational position determines the start of the stroke of the pump plunger during every pump plunger stroke in the course of its rotation. A change in the commencement of injection is achieved in this way. The rotational position of the roller ring can be detected by a transmitter 30 and reported to a control device 31 which in turn controls the electromagnet valve 27.

At the commencement of the pump plunger delivery stroke the fuel displaced by the pump plunger can be displaced without a substantial build-up of pressure in the pump work space 10 via a fuel duct 33 which shares with the non-return valve 16 a portion of the filling duct 15 located upstream of the latter 16 until an electrically controlled valve 34 in the fuel duct 33 is opened. The fuel duct 33 downstream of the electrically controlled valve is connected with the filling duct 15 downstream of the non-return valve 16.

The electrically controlled valve 34 is controlled by the control device 31 and opened during the respective suction stroke of the pump plunger so that the pump work space can be filled with fuel via the fuel duct 33 and parallel to the latter via the filling duct 15. The fuel duct 33 can be opened first with the commencement of the delivery stroke of the pump plunger, whereas the filling duct is closed by the non-return valve 16. When the electrically controlled valve closes, high pressure is built up in the pump work space with the delivery of the displaced fuel to the fuel injection nozzle 13 via the longitudinal duct 9, the distributor slot 8 and the fuel injection line 7 controlled by the latter. At the end of the high-pressure delivery of fuel the electrically controlled magnet valve 34 is opened again so that the pump work space can be relieved via the fuel line 33 to the pump suction space 17. This is advantageously used to correct the opening times of the electrically controlled magnet valve 34 so as to compensate for the effect of temperature on the fuel injection quantity.

Figure 2:
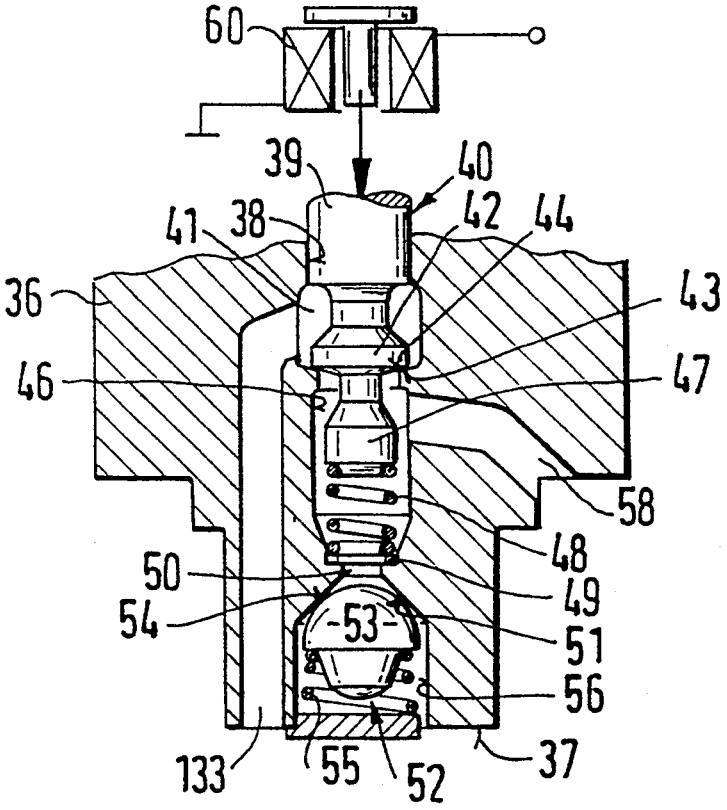
FIG. 2 is a view showing a detail of the fuel injection pump of the present invention.

FIG. 2 shows an embodiment example of the electrically controlled valve 34 in which the non-return valve 16 is integrated. The valve is constructed as an electromagnet valve and has a valve housing 36 which adjoins the pump work space 10 according to FIG. 1 at its front side 37 and seals it tightly. A guide bore hole 38 in which a shaft 39 of the valve member 40 is guided is provided in the valve housing. The guide bore hole 38 opens into an annular space 41 into which the closing part 42 of the valve member 40 adjoining the shaft 39 projects. The closing part 42 has a conical sealing surface 43 at its side facing away from the shaft 39 which cooperates with a corresponding conical annular valve seat 44. The valve seat defines a bore hole 46 which continues further coaxially relative to the guide bore hole 39. A continuation 47 of the valve member 40 projects into the bore hole 46, a return spring 48 being supported at the front of the continuation 47. The return spring is supported on the other side in a narrowing portion 49 of the bore hole 46 which merges into a through-opening 50 to the guide bore hole. A conical seat 51 of a non-return valve 52 adjoins the through-opening. The non-return valve 52 has a half-spherical element as valve closing member 53, the spherical surface 54 of this element cooperating with the conical seat 51 as sealing surface. The back of the valve closing member is acted upon by a closing spring 55 which is supported at a bore hole 56 leading away from the conical seat 51 and opening directly into the pump work space to the guide bore hole 38.

A fuel duct 133 corresponding to the fuel duct 33 of FIG. 1 leads from the front side 37 into the valve housing parallel to the axis of the guide bore hole, opens into the annular space 41 and leads from the latter via the annular valve seat to the bore hole 36 from which it leads to the pump suction space 17 as a transverse bore hole 58 to the fuel tank.

The valve member is actuated by an electromagnet 60, which is integrated in the valve housing 36 in a manner not shown in more detail, and when acted upon by the flow presses the valve member 40 onto the valve seat against the force of the return spring 48 and closes the fuel duct 33. When the pump plunger executes the suction stroke when the valve is closed, the pump plunger can suck fuel out of the pump suction space 17 via the transverse bore hole 58 which is part of the fuel duct 33 of FIG. 1, or 133 of FIG. 3, and via the non-return valve 52. The bore hole 46, the opening 50, the conical seat 51 and the bore hole 56 form the filling duct designated by 15 in the embodiment example according to FIG. 1. During the pressure stroke of the pump plunger the non-return valve is closed, particularly when the valve member 40 is also in the closed position, and when the magnet is not excited the valve member 40 changes to the open position and terminates the injection in an operation analogous to that described in FIG. 1. This construction has the advantage that it is very compact and needs no unnecessary line connections which also constitute dead space etc.

It will be understood that each of the elements described above, or two or more together, may also find a useful application in other types of constructions differing from the types described above.

While the invention has been illustrated and described as embodied in a fuel injection pump for internal combustion engines, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A fuel injection pump for internal combustion engines, comprising a pump cylinder; a pump plunger enclosing a pump work space and reciprocating in said pump cylinder; a fuel injection valve; a fuel injection line connectable with said pump work space and leading to said fuel injection valve; a fuel supply; a fuel duct connecting said pump work space with said fuel supply; an electrically actuated valve controlling said fuel duct; a filling duct connecting said pump work space with said fuel supply and containing a non-return valve which opens in the direction of said pump work space, said fuel flowing through said fuel duct when said electrically actuated valve is open in a filling position as well as in an emptying position depending on a pump plunger movement, said filling duct extending parallel to said electrically actuated valve, said fuel duct having portions which are located upstream and downstream of said electrically actuated valve and are connected with one another.

2. A fuel injection pump for internal combustion engines, comprising a pump cylinder; a pump plunger enlisting a pump work space and reciprocating in said pump cylinder; a fuel injection valve; a fuel injection line connectable with said pump work space and leading to said fuel injection valve; a fuel supply; a fuel duct connecting said pump work space with said fuel supply; an electrically actuated valve controlling said fuel duct; a filling duct connecting said pump work space with said fuel supply and containing a non-return valve which opens in the direction of said pump work space, said fuel flowing through said fuel duct when said electrically actuated valve is open in a filling position as well as in an emptying position depending on a pump plunger movement; a valve housing through which said fuel duct is guided; a non-return valve arranged in said valve housing; an electromagnet; a return spring, said electrically controlled valve being formed as a seat valve with a valve member which is actuated by said electromagnet against a force of said return spring and cooperates with a valve seat defining said fuel duct guided through said valve housing, said filling duct leading away from a portion of said fuel duct in said valve housing on a fuel side and opening into said pump work space via said non-return valve arranged in said valve housing.

3. An fuel injection pump as defined in claim 1, wherein said portions of said fuel duct located upstream and downstream of said electrically actuated valve are connected with one another by said filling duct.

4. A fuel injection pump as defined in claim 1; and further comprising a cam drive controlling the reciprocating movement of said pump plunger.

5. A fuel injection pump as defined in claim 1, wherein said fuel duct simultaneously forms a portion of said filling duct located upstream of said non-return valve.

6. A fuel injection pump as defined in claim 1; and further comprising a common valve housing provided for said electrically controlled valve and said non-return valve.

7. A fuel injection pump as defined in claim 2, wherein said valve housing has a front side adjoining said pump work space, said valve member being acted upon by said return spring on its side remote from said electromagnet, said valve housing having a bore hole which supports said return spring and is coaxial to said valve member, said bore hole opening axially into said pump work space via said non-return valve, said fuel duct opening into said bore hole on another side proceeding from said pump work space via said valve seat and proceeding from said fuel supply.

8. A fuel injection pump as defined in claim 1; and further comprising a plurality of fuel injection lines; and a cam drive setting said pump plunger in reciprocating pumping motion and also in rotating motion, so that said pump plunger serves to distribute a fuel quantity displaced by said pump plunger into one o a plurality of said fuel injection lines.

* * * * *